US005091834A

United States Patent [19]

Kao et al.

[11] Patent Number: 5,091,834

[45] Date of Patent: Feb. 25, 1992

[54] UNIVERSAL LIGHTING FIXTURE REPLACEABLE WITH DIVERSIFIED LAMPS

[76] Inventors: Yu-Tai Kao; Yu-Hsin Kao, both of c/o Hung Hsing Patent Service Center, P.O. Box 55-1670, Taipei, Taiwan

[21] Appl. No.: 687,620

[22] Filed: Apr. 19, 1991

[51] Int. Cl.[5] ..... F21S 1/12

[52] U.S. Cl. ..... 362/226; 362/410

[58] Field of Search ..... 362/226, 410, 413, 414, 362/418; 438/271, 273, 283

[56] References Cited

U.S. PATENT DOCUMENTS

| | | | |
|---|---|---|---|
| 3,133,703 | 5/1964 | Monroe | 362/226 |
| 3,506,820 | 4/1970 | Shannon | 362/226 |
| 3,900,725 | 8/1975 | Komon | 362/226 |
| 4,318,160 | 3/1982 | Dooley et al. | 362/410 |
| 4,449,169 | 5/1984 | Warshawsky | 362/413 |
| 4,525,773 | 6/1985 | Hesse et al. | 362/226 |
| 4,956,756 | 9/1990 | Hsiao | 362/226 |

*Primary Examiner*—Richard R. Cole

[57] ABSTRACT

A lighting fixture includes: a first lamp secured with a coupling plug which is detachably engageable with a coupling socket formed on a supporting base so that a second or another lamp provided with a coupling plug may be optionally chosen to substitute the first lamp by dismantling the first lamp from the base so as for enhancing diversified lighting or decorative purposes of the lighting fixture.

4 Claims, 4 Drawing Sheets

UNIVERSAL LIGHTING FIXTURE REPLACEABLE WITH DIVERSIFIED LAMPS

BACKGROUND OF THE INVENTION

A conventional table lamp as shown in FIG. 8 may be rotated or operated for adjusting its height and position for drawing lighting purpose or other uses. A power cord C is connected from a power source P through several supporting arms S to a lamp or bulb L. Such a power cord C may be twisted to cause breakage of cord during an adjustment movement of the lamp L and supporting arm S. Meanwhile, the lamp L is fixed on an upper end portion of the supporting arm S and can not be conveniently replaced with other kinds of lamps, thereby lacking of diversified lighting functions.

The present inventors have found the drawbacks of a conventional lamp and invented the present lighting fixture which can be replaced with diversified lamps.

SUMMARY OF THE INVENTION

The object of the present invention is to provide a lighting fixture including a first lamp secured with a coupling plug detachably engageable with a coupling socket formed on a supporting base having a transformer adapter mounted in the base so that a second lamp provided with a coupling plug on the second lamp may be chosen to substitute the first lamp for diversified lighting purposes.

DETAILED DESCRIPTION

As shown in FIGS. 1–4, the present invention comprises: a lamp 5 or 5', a plurality of connecting tubes 4 coaxially connected in series and connected between the lamp 5 or 5' and a supporting base 3 having a transformer adapter 6 mounted in the base 3.

Figure 1:
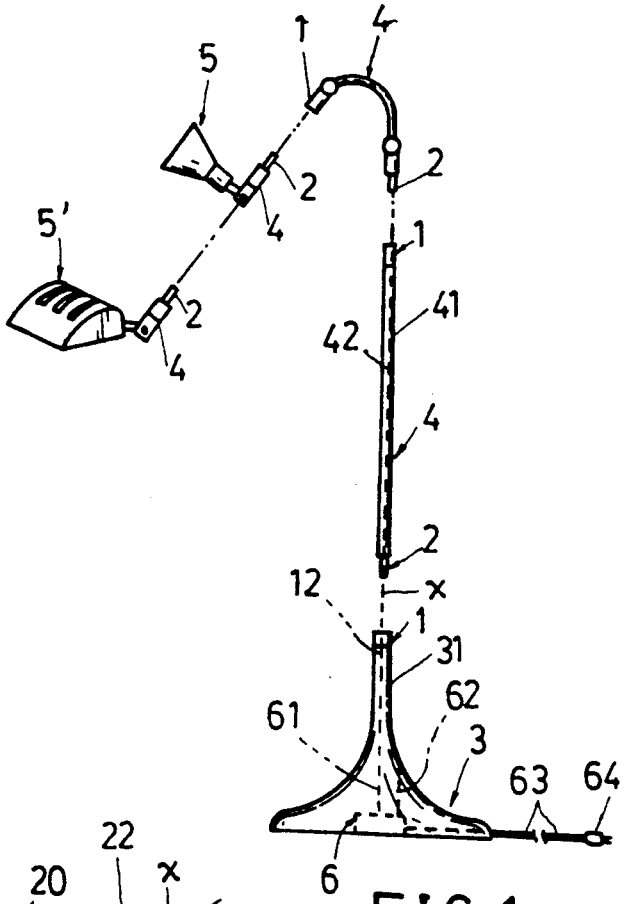
FIG. 1 is an illustration of the present invention for serving as a floor lamp.

The supporting base 3 is formed with a coupling socket 1 on an end or upper portion of the base 3 engageable with a coupling plug 2 formed on a lower portion of a connecting tube 4 secured with the lamp 5 or 5' or coupled with the other connecting tubes as shown in FIG. 1.

Figure 2:
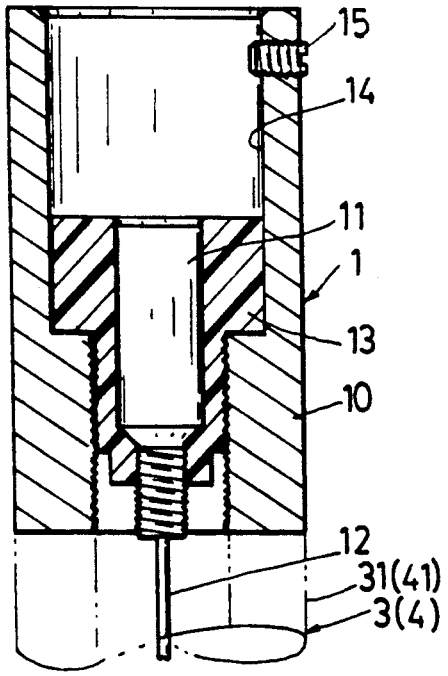
FIG. 2 is a sectional drawing of a coupling socket of the present invention.

Each coupling socket 1 as shown in FIG. 2 includes: an outer cylindrical wall 10 defining a socket portion 14 within the cylindrical wall 10, a core female connector 11 generally cylindrical shaped and connected with a first core conductor 12 to be positioned in a cord portion of the coupling socket 1, a first insulative packing 13 packed between the female connector 11 and the cylindrical wall 10, and a limiting screw 15 adjustably fixed in an upper portion of the cylindrical wall 10. The first core conductor 12 may be clad with insulative material thereon.

The coupling socket 1 may be integrally secured on the upper portion of the base 3 or secured on an upper end portion of a connecting tube 4. For securing the socket 1 on the base 3, the outer cylindrical wall 10 of the socket 1 is integrally connected with a hollow cylindrical wall 41 of the base 3 and the first core conductor 12 is electrically connected with a first pole 61 from a transformer adapter 6 mounted in the base 3.

The transformer adapter 6 may be a transformer (not shown) for reducing voltage from a higher voltage such as 110 volts to be a lower voltage such as 12 volts, not hazardous to a human body or may be further provided with a rectifier (not shown) for rectifying an input alternative current to a direct current. The adapter 6 includes a first pole 61 (for instance, a positive pole) connected to the first core connector 12 of the socket 1, a second pole 62 (for instance, a negative pole) connected to the outer cylindrical wall 31 of the base 3, and a power cord 63 provided with a power supply plug 64 to be connected to a power source such as an alternative current of 110 volts. Naturally, the adapter 6 may be modified to be a power source of direct current such as several batteries stored in the base 3.

Each connecting tube 4 includes a hollow tubular wall 41 and a core connector 42. A plurality of connecting tube 4 may be connected in series to form an extension connecting tube 4 as shown in FIG. 1, in which each connecting tube 4 includes a coupling plug 2 formed on a first or lower portion of the tube 4 and a coupling socket 1 formed on a second or upper portion of the tube 4. The hollow tubular wall 41 of the connecting tube 4 may be connected with the outer cylindrical wall 10 of the socket 1 secured on an upper end portion of the connecting tube 4, or may be connected with the hollow cylindrical wall 31 of the base 3. The core connector 42 is made as electrically insulative.

Figure 3A:
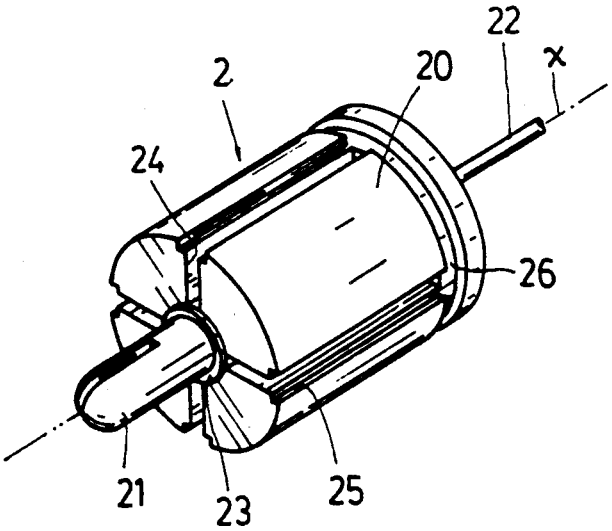
FIG. 3*a* is a perspective view of the coupling plug of the present invention.
Figure 3:
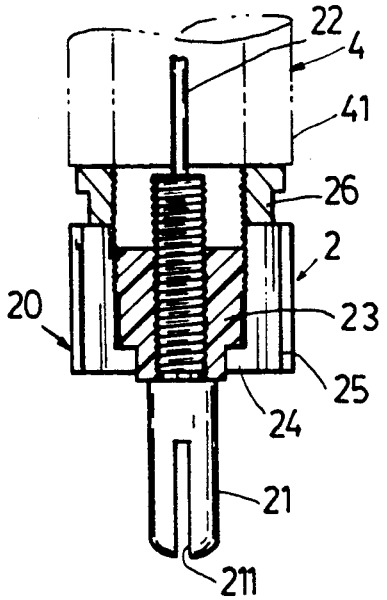
FIG. 3 is a sectional drawing of a coupling plug of the present invention.

Each coupling plug 2 as shown in FIGS. 3, 3*a* includes: an outer plug portion 20 forked to form a plurality of forked slits 24 longitudinally slotted through the outer plug portion 20 for resiliently engaging the outer plug portion 20 in the socket portion 14 of the coupling socket 1, an inner plug portion 21 protruded coaxially beyond the outer plug portion 20 and connected with a second core conductor 22 to be positioned in a core portion of the plug 2, a second insulative packing 23 packed between the second core conductor 22 and the outer plug portion 20, a plurality of shallow grooves 25 longitudinally formed in a circumference surface of the outer plug portion 20 and parallel to an axis X of the plug 2 each shallow groove 25 being coincided with each forked slit 24 slotted through the outer plug portion 20, and an annular groove 26 circumferentially recessed in the plug 2 opposite to the inner plug portion 21 and generally perpendicularly intersecting the slits and grooves 24, 25. The core conductor 42 of the connecting tube 4 has its two ends respectively connected with the first and second conductors 12, 22.

Figure 4:
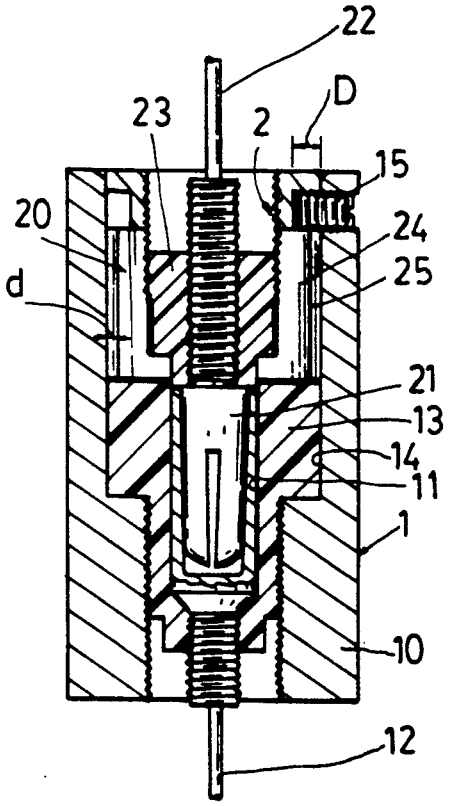
FIG. 4 is a sectional drawing showing an engagement of the plug with the socket in accordance with the present invention.

The inner plug portion 21 may be bifurcated or forked to form a plurality of prongs 211 to be resiliently engaged with the female connector 11 of the socket 1 as shown in FIG. 4. All plugs 2 and sockets 1 should be made of electrical conductive materials except the insulative packings 13, 23, and the insulative materials clad on the conductors 22, 12.

A depth D of the annular groove 26 is greater than a depth d of the shallow groove 25. A width of said shallow groove 25 is wider than that of said forked slit 24. Each shallow groove 25 is slidably engageable with an inner portion of the limiting screw 15 of the socket 1 so that the plug 2 can be slidably mounted into the socket 1. After engaging the plug 2 with the socket 1 as shown in FIG. 4, the screw 15 can be plugged inwardly to poke into the annular groove 26 beyond the shallow groove 25 for preventing a disengagement of the plug 2 from the socket 1 and ensuring a real coupling of the plug 2 with the socket 1. Naturally, the screw 15 can not be plugged to tightly to relatively rotate the plug 2 within the socket 1 for an universal coupling of the plug 2 with the socket 1.

For practical uses, a first lamp 5 may be connected with several connecting tubes 4 as shown in FIG. 1 to connect the supporting base 3 to serve as a floor lamp. The first lamp 5 may be replaced with a second lamp 5'. The first and second lamps 5, 5' can be optionally chosen from those lamps wellknown in the market, for instance, a spot light, a high-intensity lamp, a fluorescent lamp, a halogen lamp, an incandescent bulb, and so on, which are not limited in this invention. The lamp 5, 5' can be universally oriented by rotating each plug 2 in each engaged socket 1. The screw 15 of the socket will limit the plug 2 to prevent a gravitational drop or releasing of the plug 2 from the socket 1.

Figure 5:
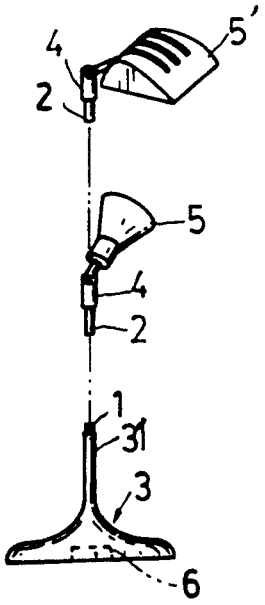
FIG. 5 shows a table lamp of the present invention.

As shown in FIG. 5, a table lamp is formed by directly engaging a plug 2 formed on a connecting tube 4 secured on a lower portion of the lamp 5, 5' with a socket 1 formed on the base 3. The connecting tube 4 secured with the lamp 5 includes its hollow tubular wall 41 and core conductor 42 respectively connected with two poles of the lamp or bulb so that the lamp can be powered by the power source 6 provided in the base 3 through an electrical connection of the plug 2 and the socket 1 as aforementioned.

Figure 6:
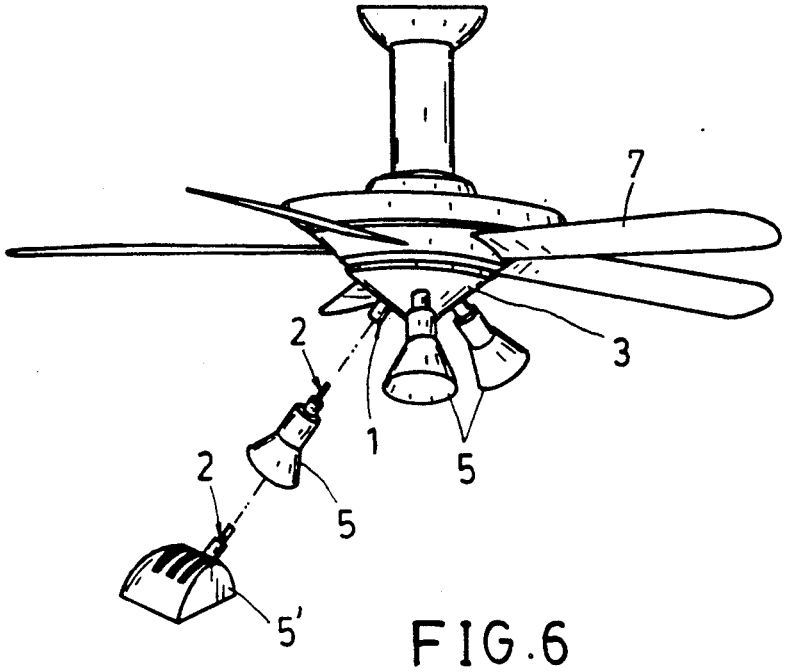
FIG. 6 shows a lamp of the present invention secured with a ceiling fan.
Figure 7:
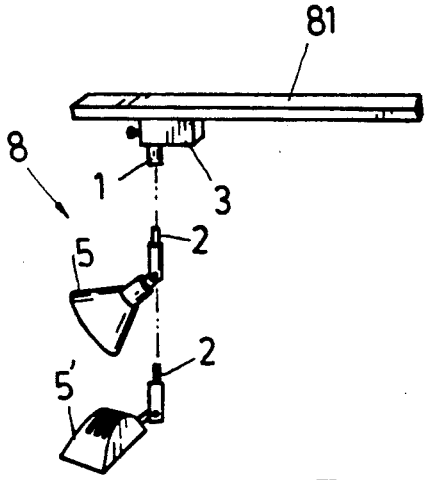
FIG. 7 shows a track light of the present invention.
Figure 8:
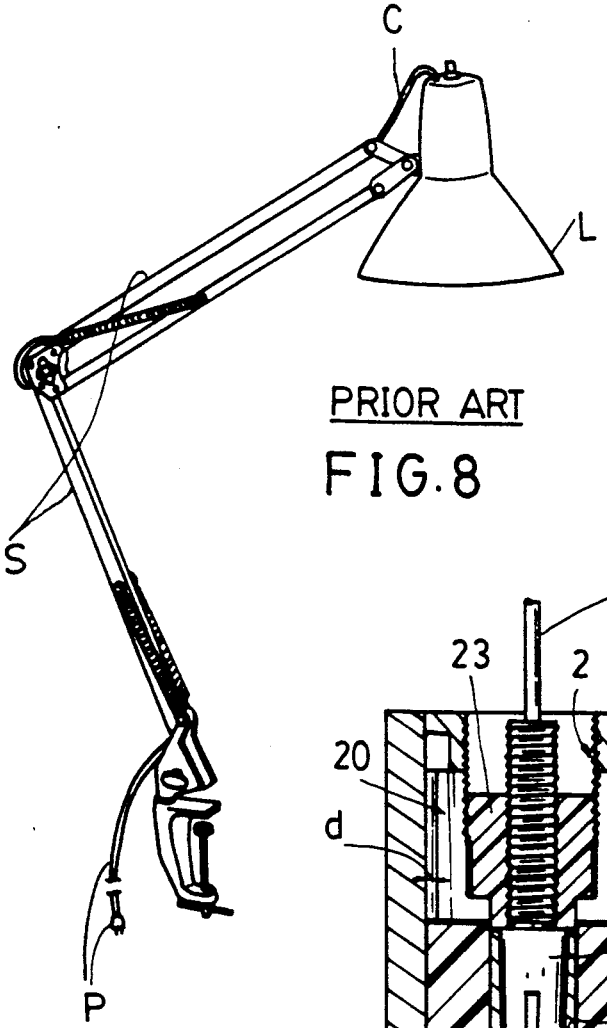
PRIOR ART FIG.8
FIG. 8 shows a conventional table lamp.

As shown in FIG. 6, a plurality of first lamps 5 are mounted on a base 3 of a ceiling fan 7 in which any first lamp 5 can be optionally replaced with a second lamp 5' for diversified decorative purpose or for maintenance job.

in FIG. 7, a track light 8 is illustrated in which a base 3 for replaceably mounting the lamp 5 or 5' may be slid along a track 81 which may be fixed on a ceiling or a wall.

The present invention can be suitably modified by those skilled in the art without departing from the spirit and scope as claimed in this invention.

The present invention is superior to a conventional lamp with the following advantages:

1. The lamps can be optionally replaceably mounted on a base 3 or on a connecting tube for diversified uses or functions.

2. The lamp can be universally oriented without twisting and breaking power connecting means since all connecting tubes 4, plugs 2 and socket 1 are coaxially connected in series for a free rotation thereof.

3. A quicker and cost-saving maintenance job can be done by the convenient engagement of each plug 2 with each socket 1.

We claim:

1. A lighting fixture comprising:

a lamp secured with a connecting tube having a coupling plug integrally formed with the connecting tube; and a supporting base having a coupling socket formed on an end portion of said base detachably engageable with said coupling plug formed on the connecting tube of said lamp, and having a transformer adapter mounted in said base for reducing voltage from an input power source; said coupling plug coaxially rotated in said coupling socket as limited by a limiting screw adjustably fixed in said socket;

said adapter having a first pole electrically connected with a core conductor formed in each said socket, said plug and said connecting tube for connecting a first pole of said lamp, and having a second pole of said adapter electrically connected with an outer portion formed in each said base, said socket, said plug and said connecting tube for connecting a second pole of said lamp;

said coupling socket including: an outer cylindrical wall defining a socket portion within said cylindrical wall, a core female connector generally cylindrical shaped connected with a first core conductor clad with insulative material to be positioned in a core portion of said coupling socket, a first insulative packing packed between said female connector and said outer cylindrical wall, and said limiting screw adjustably fixed in said cylindrical wall; and said coupling plug including: an outer plug portion engageable with said socket portion of said coupling socket, an inner plug portion protruded axially beyond said outer plug portion to be engageable with said female connector of said socket, a second core conductor connected with said inner plug portion positioned in a core portion in said coupling plug, a second insulative packing packed between said second core conductor and said outer plug portion, and an annular groove circumferentially recessed in said outer plug portion generally perpendicular to an axis of said plug, said annular groove operatively engaged with said limiting screw then inwardly plugged into said groove from said outer cylindrical wall of said socket for rotatably limiting said plug and preventing a releasing of said plug from said socket, the improvement which comprises:

said outer plug portion of said coupling forked to form a plurality of forked slits longitudinally formed in said outer plug portion for resiliently engaging said outer plug portion of said coupling plug in said socket portion of said coupling socket; and said outer plug portion of said coupling plug formed with a plurality of shallow grooves longitudinally recessed in said circumference surface of said outer plug portion for slidably guiding said limiting screw on said socket for coupling said plug into said socket.

2. A lighting fixture according to claim 1, wherein a depth of each said shallow groove is shallower than a depth of said annular groove in said plug.

3. A lighting fixture according to claim 1, wherein each said shallow groove is coincided with each said forked slit in said plug.

4. A lighting fixture according to claim 1, wherein said inner plug portion of said coupling plug is bifurcated or forked to form a plurality of prongs for resiliently engaging said inner plug portion in said female connector of said coupling socket.

* * * * *